US005542851A

United States Patent [19]

Chikano

[11] Patent Number: 5,542,851

[45] Date of Patent: Aug. 6, 1996

[54] ELECTRICAL CONNECTOR WITH IMPROVED GROUNDING

[75] Inventor: Koji Chikano, Tokyo, Japan

[73] Assignee: Kel Corporation, Tokyo, Japan

[21] Appl. No.: 311,939

[22] Filed: Sep. 26, 1994

[30] Foreign Application Priority Data

Sep. 24, 1993 [JP] Japan ..... 5-261953

[51] Int. Cl.[6] ..... H01R 13/658

[52] U.S. Cl. ..... 439/108; 439/608

[58] Field of Search ..... 439/101, 108, 439/607, 608

[56] References Cited

U.S. PATENT DOCUMENTS

| | | | |
|---|---|---|---|
| 4,806,110 | 2/1989 | Lindeman | 439/108 |
| 5,057,028 | 10/1991 | Lemke et al. | 439/108 |
| 5,120,232 | 6/1992 | Korsunsky | 439/108 |
| 5,360,349 | 11/1994 | Provencher et al. | 439/108 |

FOREIGN PATENT DOCUMENTS 5205823 8/1993 Japan .

*Primary Examiner*—Gary F. Paumen
*Attorney, Agent, or Firm*—Robert W. J. Usher

[57] ABSTRACT

A electrical connector assembly comprising first and second, intermatable connector members including respective housings with rows of terminals and rows of ground plate portions extending in spaced apart, side by side relation. Ground plate portions of one connector member include resilient contact portions which are staggered so as to be offset on respective opposite lateral side of a center line of the row thereof and retained in respective housing cavities formed in the housing. A row of correspondingly staggered finger-like projections are provided in the other housing and have guiding and other ground plate supporting portions on respective opposite lateral sides thereof facing in opposite lateral directions and receivable in the respective cavities during movement of the connector members into mating engagement both to support the other ground plate portions in electrical engagement with the resilient ground plate portions and to guide the two housings accurately together.

7 Claims, 10 Drawing Sheets

ELECTRICAL CONNECTOR WITH IMPROVED GROUNDING

FIELD OF THE INVENTION

This invention concerns a electrical connector, particularly for interconnecting circuit boards, having improved grounding.

BACKGROUND OF THE INVENTION

An example of a prior connector of the general type is taught by U.S. Pat. No. 5,120,232 issued to Korsunksy in 1992 and comprises first and second intermatable connector members including first and second insulating housings, respectively, with first and second mating and lead faces, respectively; a row of terminals and a row of ground plate portions retained in each housing, extending in spaced apart, side by side relation. When the connector members are mated, the corresponding terminals of the two connector parts electrically engage each other and ground plate portions of the two connector parts electrically engage each other. Since the ground plates are connected to the ground circuits of the circuit boards and form electrical shields between the terminals, signal cross-talk between the terminals is reduced or prevented and a high-density arrangement of the terminals is feasible.

Ground plate portions of the first and second connector members are each stamped and formed from a single piece of sheet metal and have resilient and essentially rigid contact portions, successive of which are staggered so that alternate contact portions are laterally offset from each other on respective opposite lateral sides of a center line of the row thereof. When the connector members are mated, the essentially rigid second ground plates are interwoven between the resilient contact portions of the first ground plates, so that the contact between the ground plate portions is performed securely.

However, as the second ground plates are interwoven with the first ground plates, the structures of the ground plates are relatively complex, requiring a manufacturing process involving staggered bending which can be relatively difficult.

SUMMARY OF THE INVENTION

An object of the invention is to provide an electrical connector in which the structure of the ground plates is simplified, at least for manufacturing purposes.

An additional object of the invention is to provide a connector in which the connection between the ground plates acts as a guide during mating of the connector members.

According to one aspect of the invention, there is provided an electrical connector assembly comprising first and second, intermatable connector members including first and second insulating housings, respectively, with first and second mating and lead faces, respectively; a row of terminals and a row of ground plate portions retained in each housing, extending in spaced apart, side by side relation. The ground plate portions of the first connector member have respective resilient contact portions, successive of which are staggered so that alternate resilient contact portions are laterally offset from each other on respective opposite lateral sides of a center line of the row thereof. The ground plate portions of the said second connector member are substantially coplanar and have contact faces. The first housing being formed with a row of contact portion receiving cavities opening to the mating face; and, the second housing being formed with a row of ground plate portion supporting members having respective leading free ends projecting towards the mating face and formed with supporting surface portions and guiding surface portions facing in opposite lateral directions, successive of the leading free ends being staggered so that alternate leading free ends are laterally offset from each other on respective opposite lateral sides of a center line of the row of ground plate portions with successive supporting surface portions engaging opposite faces of successive ground plates of the second connector member so that successive contact surfaces thereof are exposed in opposite lateral directions, so that, during movement of the connectors into mating engagement, the leading free ends of the ground plate portion supporting members enter respective contact portion receiving cavities both supporting the respective contact surfaces of the ground plate portions in electrically connecting engagement with the respective resilient contact portions therein with resilient deflection thereof, and guiding the connector members together accurately so that corresponding terminals of the first and second connector members are interconnected.

In accordance with this construction. It is only necessary for the resilient ground plate portions of the first connector member to be staggered when retained in the housing so as to be laterally (transversely) offset on opposite sides of a center line of the row the row portions.

The resilient ground plate portions can be formed separately and with similar shapes. Furthermore, the ground plate portions of the second connector member may be formed as a single strip- like plate, with contact faces with which the said resilient contact portions are pressed into contact. As a result, the structures of the ground plates are simple and they are easily manufactured.

When the connector members are mated, enter respective contact portion receiving cavities both pressing the contact surfaces of the ground plate portions into electrical engagement with the resilient contact portions of the second connector member and guiding the two connector members together accurately improving the precision with which the connector members are fitted together ensuring reliable electrical connection between corresponding terminals thereof.

BRIEF DESCRIPTION OF THE DRAWINGS

A specific embodiment of an electrical connector assembly according to the invention will now be described by way of example only and with reference to the accompanying drawings in which.

DETAILED DESCRIPTION

Figure 1:
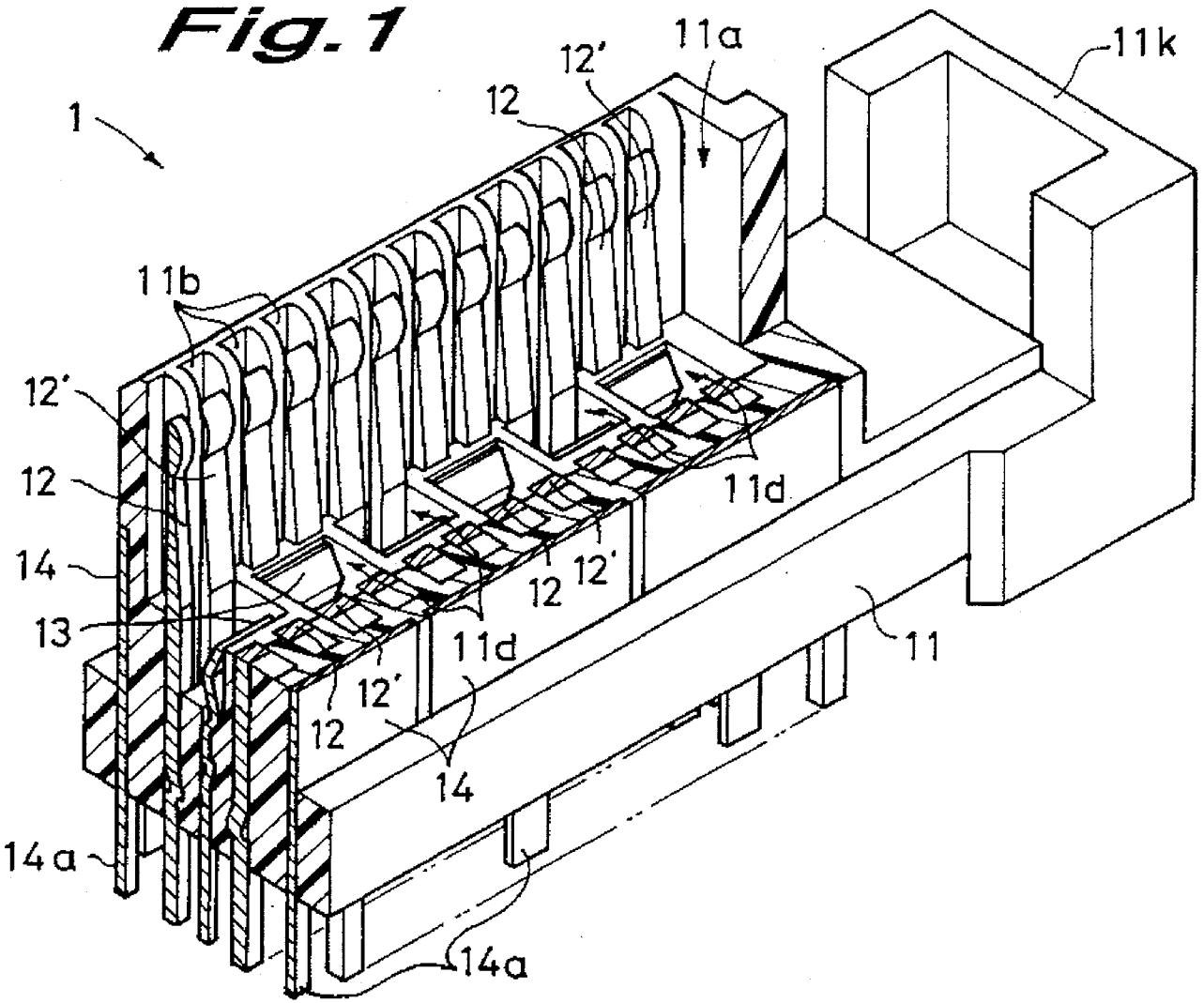
FIG. 1 is a fragmentary perspective view, partly in cross-section of a first connector member of the assembly.

As shown in FIG. 1, a first connector member 1 comprises a rectanguloid first housing 11, molded in one piece from insulating resin or plastic; two types of pin form, first terminals 12, 12', each stamped and formed form metal stock and mounted in respective rows which extend longitudinally of the first housing 11 and are located on both lateral sides thereof; a series of first, central ground plate portions 13, which are stamped and formed from sheet metal and retained in rows extending in the longitudinal direction of the first housing and which are at laterally spaced apart locations on both sides thereof, between the rows of terminals 12, 12' and in parallel spaced apart relation therefrom; and a series of first side ground plate portions 14, 14, which are stamped and formed as flat plates from sheet metal stock and retained in longitudinally extending rows adjacent respective longitudinal walls ends of the first housing 11.

Figure 2:
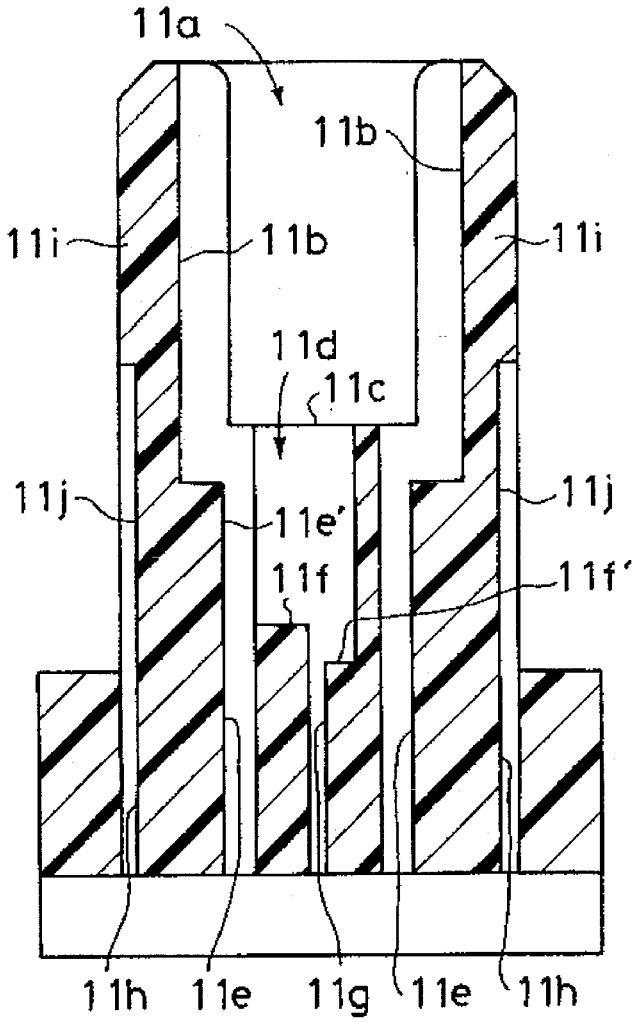
FIG. 2 is a transverse cross-sectional view of the housing of the first connector member.

As shown in detail in FIGS. 1 and 2, the first housing 11 is formed with sidewalls 11*i* extending away from an upper mating face and defining a mating recess 11*a* opening to the mating face for receiving a mating portion of the second connector member. Two longitudinally extending rows of terminal-receiving grooves 11*b*, are formed on opposite inner surfaces of the mating recess, each groove extending (vertically) away from the mating face. The grooves 11*b* communicate at inwardly stepped housing parts with terminal anchoring sockets 11*e* opening at a (bottom) lead face of the housing. The mating recess 11*b* communicates at a surface 11*c* spaced inwardly from the mating face with a series of ground plate portion receiving cavities 11*d* which extend in a row longitudinally of the housing, successive of which are staggered so that center lines of alternate cavities are laterally offset from each other on respective opposite lateral sides of a center line of the row.

Figure 3:
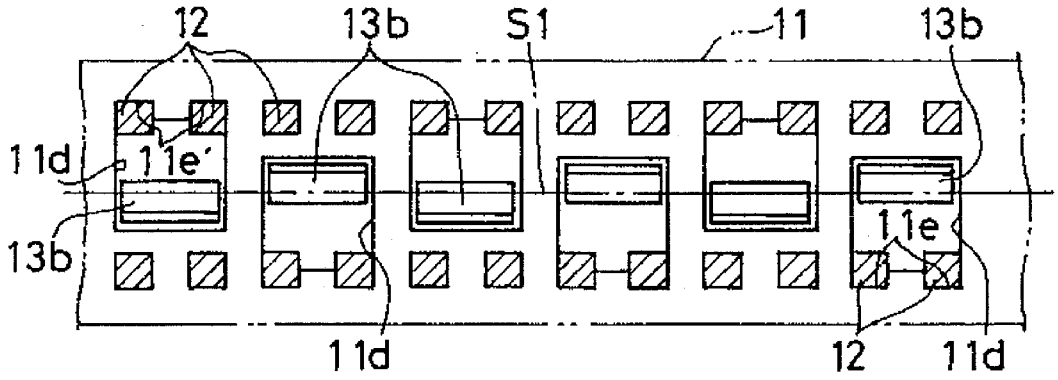
FIG. 3 is a schematic, fragmentary plan view of the first connector member.

More specifically, as shown in detail in FIG. 3, successive cavities are offset on respective opposite lateral sides of a center line S1 of the surfaces of first center ground plate portion 13.

Upper sections of alternate terminal anchoring sockets 11*e*, 11*e* of each row form grooves 11*e'* on respective offset (outer) walls of successive ground plate portion receiving cavities 11*d*. Center ground plate portion anchoring sockets 11*g*, are formed centrally of the width (laterally centrally) of the lower part of the first housing 11 and extend to bottom surfaces 11*f* of the cavities 11*d*, and stepped down surfaces 11*f'* formed on the opposite side from the offset side of the cavities 11*d* where the sockets 11*g* open out.

Rows of side ground plate portion anchoring sockets 11*h* which extend vertically to side ground plate portion locating recesses 11*j* are formed adjacent respective opposite sides of the housing. The recesses 11*j* extend to an intermediate height of outer walls 11*i* and open outward in lateral directions.

As shown in FIG. 1, attachment portions 11*k* which interfit with the second housing of the second connector member 2 are formed at both longitudinal ends of the first housing 11.

Figure 4:
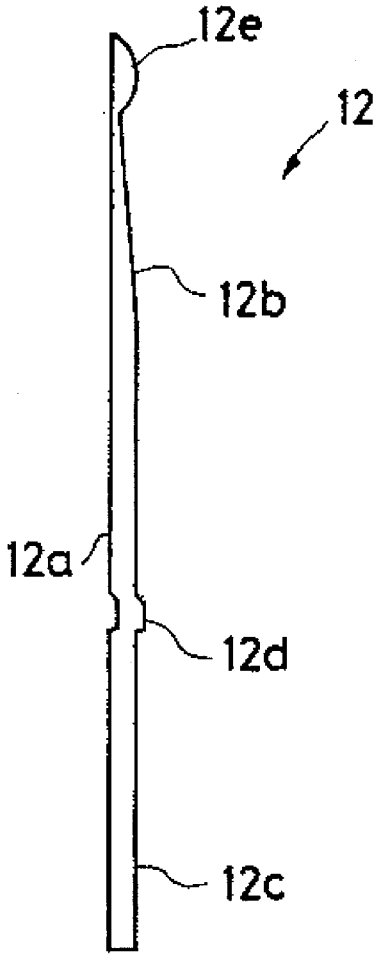
FIGS. 4(A) and 4(B) are side elevations of respective terminals of the first connector member.
Figure 4:
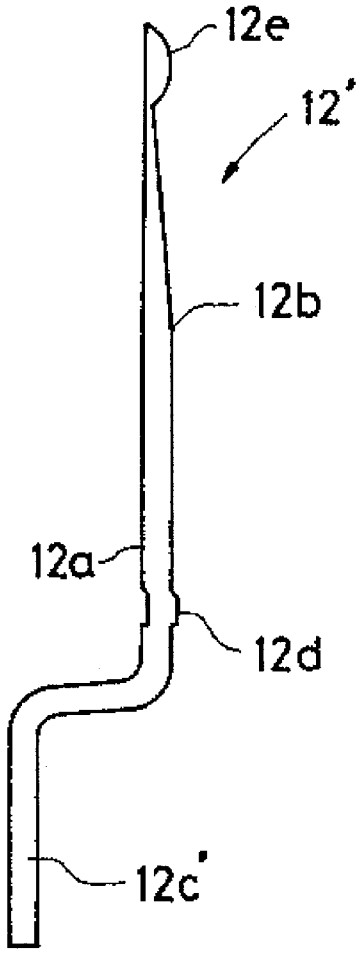

As shown in detail in FIG. 4(A), the first terminal 12 of one type comprises a straight anchoring portion 12*a* for receipt in a respective socket 11*e* as a press or force fit joined at respective opposite, upper and lower ends to a resilient contact part 12*b* which tapers to an endmost, transverse, convex contact protuberance or nib 12*e*. An anchoring projection or tooth 12*d* is struck from the anchoring portion 12*a*.

As shown in detail in FIG. 4(B), the first terminal 12' of the other type has substantially the same configuration as the one terminal 12 except for a rearward crank in the lead part 12*c'*. The same symbols have therefore been used to identify similar parts.

Figure 5:
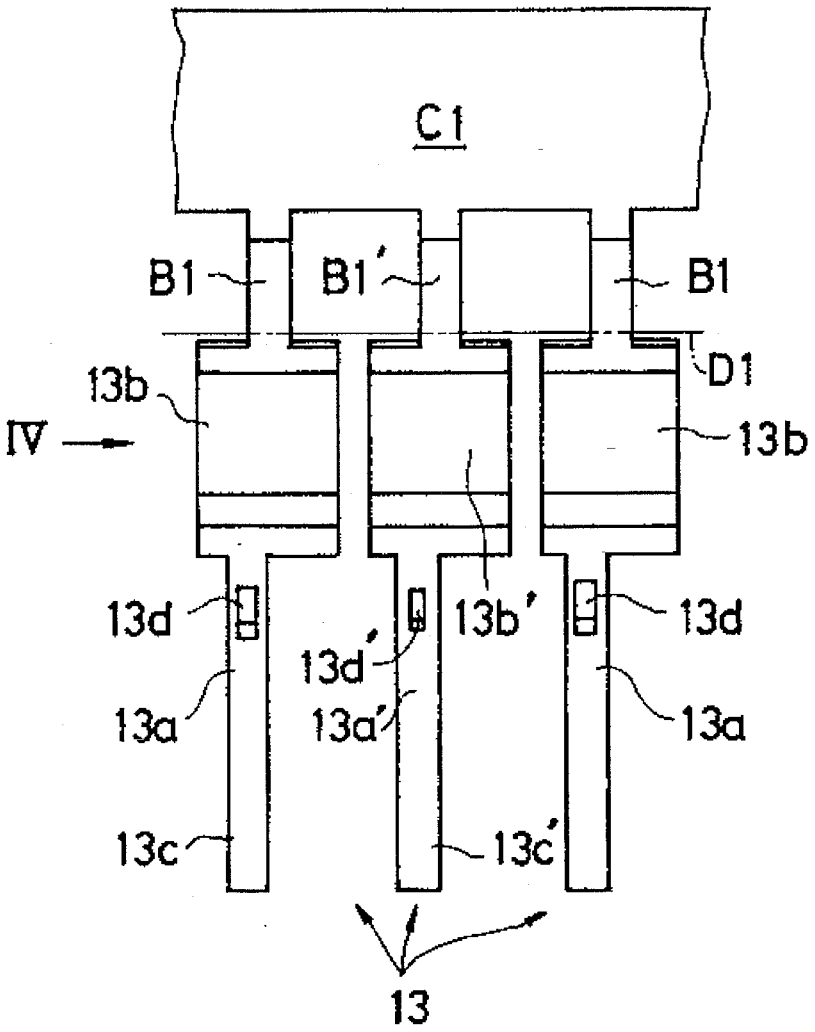
FIG. 5(A) is a plan view of ground plate portions of the first connector member.
FIG. 5(B) is an end view in direction of arrow IV in FIG. 5(A)
Figure 5:
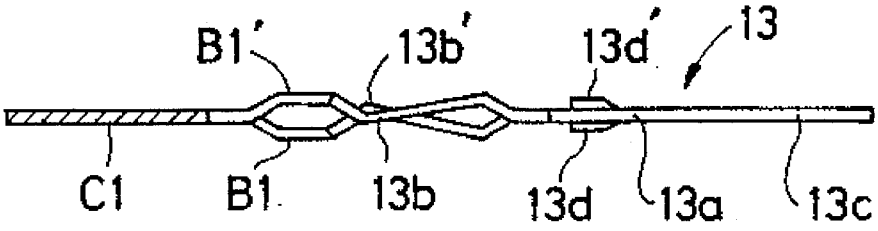

As shown in FIG. 5(A), a series of first center ground plate portions 13, are stamped from a single strip of sheet metal to extend transversely from a carrier strip C1 and then formed or bent in a press.

As shown in FIG. 5(B), each first ground plate portion 13, has an anchoring portion 13*a* which extends from one end of a resilient terminal portion 13*b* which extends leftward in the Figure and is bent upward, (in one lateral direction when mounted in the connector), downward (in the opposite lateral direction), and upward (in the one lateral direction), in that order; and a lead part 13*c* which extends rightward (downward) from the anchoring portion 13*a*. An anchoring projection or tooth 13*d* is struck from the anchoring portion 13*a*. Successive resilient terminal portions 13*b* of successive center ground plate portions 13*b'* are bent in opposite directions, so that they are staggered with adjacent portions offset on respective opposite sides of a center line. A bridge B1 (B1') connects each first center ground plate portion 13 and the carrier C1 and is bent according to the bending direction of the resilient terminal part 13*b* (13*b'*).

As shown in FIG. 1, the first side ground plate portions 14 are formed as flat plates with upper wide contact portions from which depend narrow lead portions 14*a*.

The first connector member 1 is assembled by inserting both types of first terminal 12, 12' with contact portions 12*b* leading, through the bottom, lead face into the terminal insertion holes 11*e* of the first housing 11 until their contact portions 12*b* are longitudinally aligned as respective rows in respective grooves 11*b* with the convex parts 12*e* protruding inward into the mating recess 11*a* when the respective anchoring portions are received as press fits in respective anchoring sockets 11*e* with the lead portions 12*c*, 12*c'* depending from the lead or circuit board connecting face.

While still attached to the carrier strip, first center ground plate portions 13 are then inserted, gang fashion, lead portions 13*c* first, through the mating face, pressing the anchoring portions 13*a*, 13*a'* into the center plate portion anchoring holes 11*g* of the first housing 11 so that resilient contact plate portions 13*b*, 13*b'* are received in the plate portion receiving openings 11*d* and the lead parts 13*c*, 13*c'* depend from the lead face, the simultaneous insertion step affording improved efficiency. The first center plate portions 13 are then retained as a row extending longitudinally of the housing. Subsequently, the bridges B1, B1' are severed along the cutting line D1, as shown in FIG. 5(A), separating the first center ground plate portions 13 from the carrier C1.

As shown in FIG. 3, alternate resilient contact portions 13*b*, 13*b*' of the first center plate portions 13 are arranged as respective sub rows, laterally offset on respective opposite sides of a center line S1 of the row.

The first side ground plate portions 14 are inserted through the lead face into the side plate portion anchoring sockets 11*h* of the first housing 11 so that the side ground plate portions 14 are received in the side plate receiving recesses 11*j* with contact surface exposed.

Figure 6:
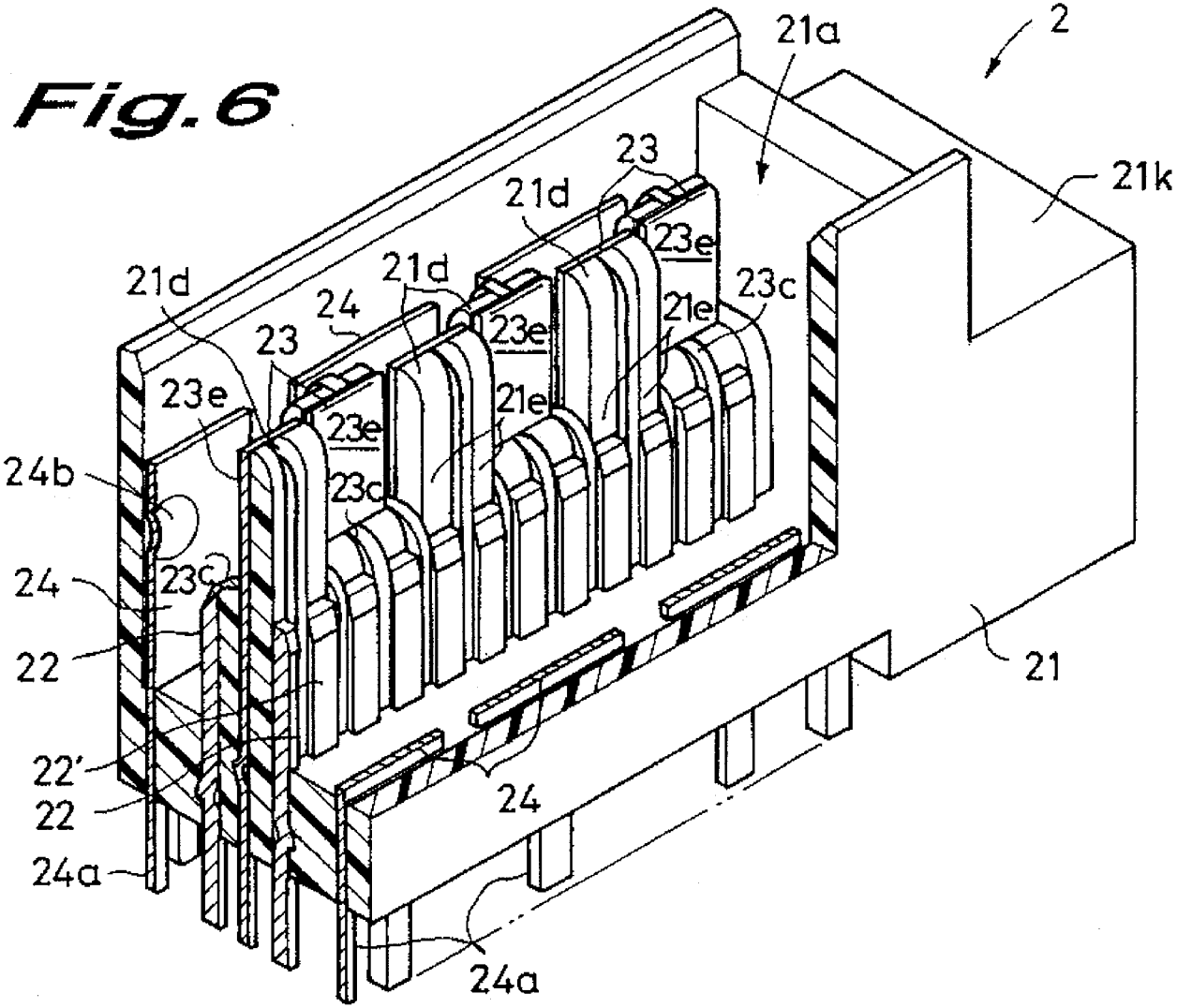
FIG. 6 is a fragmentary perspective view, partly in cross-section of a second connector member of the assembly.

As shown in FIG. 6, the second connector member also comprises a rectanguloid second housing 21, molded in one piece from insulating resin or plastic; two types of second terminals 22, 22', a series of second center ground plate portions 23, 23, and a series of second side ground plate portions 24, 24.

Figure 7:
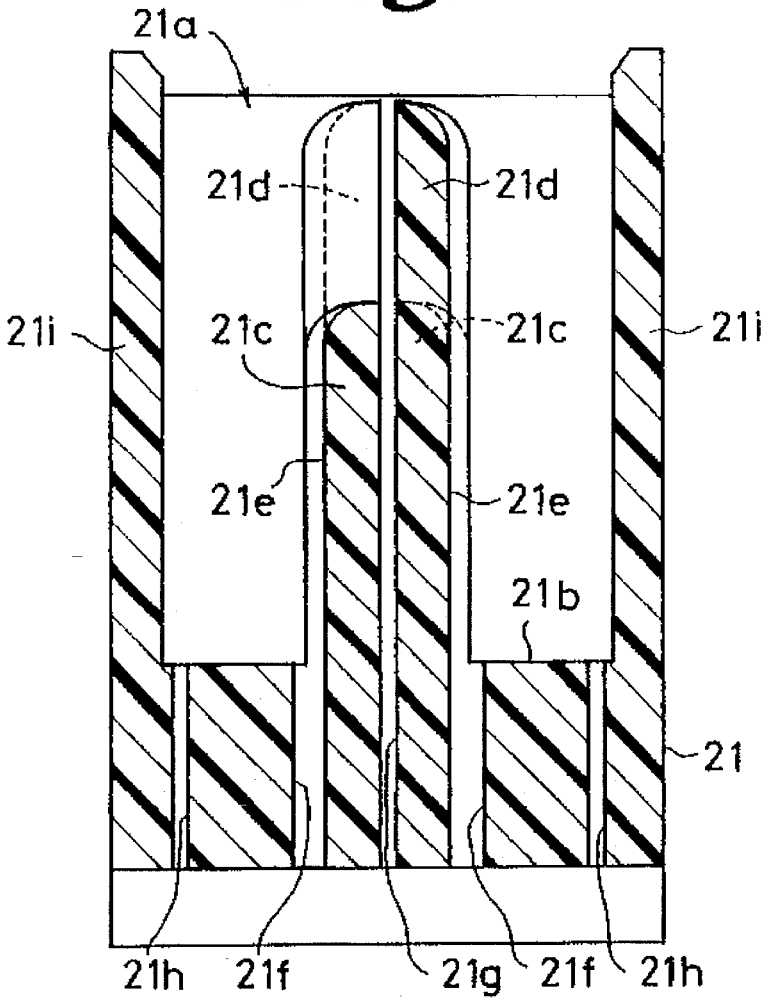
FIG. 7 is a transverse cross-sectional view of the housing of the second connector member.

As shown in detail in FIG. 7, the second housing 21 is formed with a mating recess 21*a* which opens upward to a mating face and is defined by sidewalls 21*i* extending away from the mating face to a base wall 21*b*. A terminal supporting and guiding rib extends centrally along the recess and projects towards the mating face. The rib comprises lower terminal supporting portions 21*c* which outstand from the base surface 21*b* and terminal-receiving grooves 21*e* which extend toward the mating face are formed in two rows, on respective opposite lateral sides thereof.

A row of center ground plate portion anchoring sockets 21*g*, bisects the lower terminal supporting portions 21*c*, in effect dividing it longitudinally into two lateral parts each of which has a row of end portions 21*d* which project in longitudinally spaced apart relation from the lower terminal supporting portions 21*c* to locations adjacent the mating face, with the projecting end portions 21*d* of one row being in lateral alignment with the spaces between the projecting end portions 21*d* of the other row so that successive of the projecting end portions or leading free ends are staggered, with alternate projecting end portions laterally offset from each other on respective opposite lateral sides of a center line of the row which corresponds to the longitudinal axis of the ground plate portion anchoring sockets 21*g*.

The end portions 21*d* are formed with ground plate supporting surface portions and guiding surface portions facing in opposite lateral directions so that successive supporting surface portions engage opposite faces of successive ground plates of the second connector member with successive contact surfaces thereof exposed in opposite lateral directions.

Figure 8:
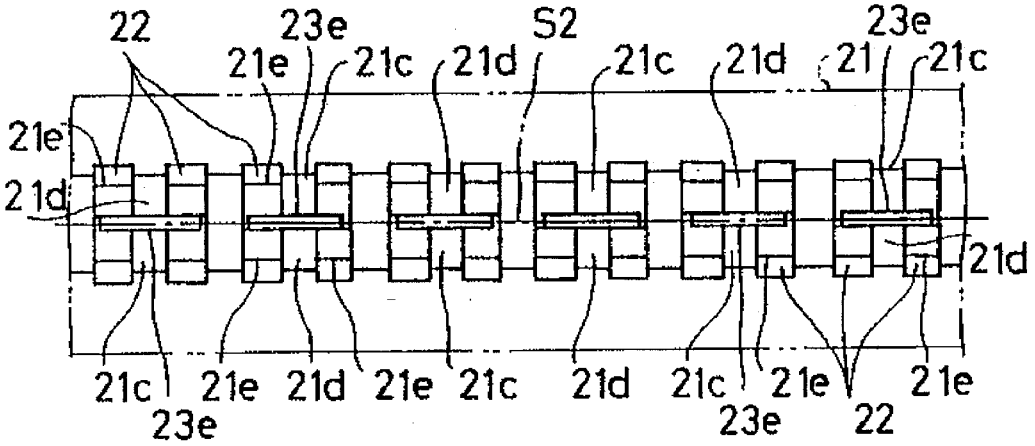
FIG. 8 is a schematic, fragmentary plan view of the second connector member.

Each lower terminal supporting portion 21*c* is formed with two adjacent terminal-receiving grooves 21*e* so that, as shown in FIG. 8, they are located as two parallel rows offset on respective opposite lateral sides of the center line S2 of the center ground plate portions 23.

As shown in FIG. 7, rows of terminal anchoring sockets 21*f*, communicate with respective terminals-receiving grooves 21*e* on both lateral sides of the rib and extend vertically therefrom to the lead face. Rows of side ground plate portion anchoring sockets 21*h* open to the mating recess 21*a* and the lead face adjacent opposite lateral walls 21*i*.

As shown in FIG. 6, attachment portions 21*k* which interfit with the first housing 11 are formed at both longitudinal ends of the second housing 21.

Figure 9:
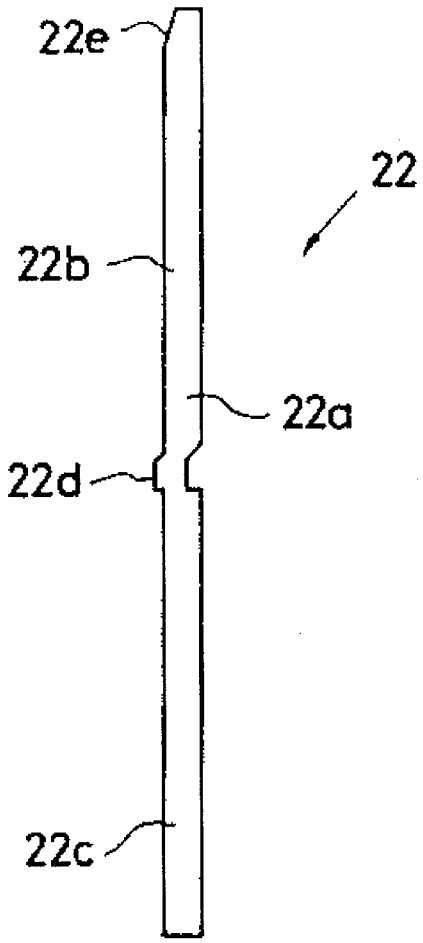
FIGS. 9(A) and 9(B) are side elevations of respective terminals of the second connector member.
Figure 9:
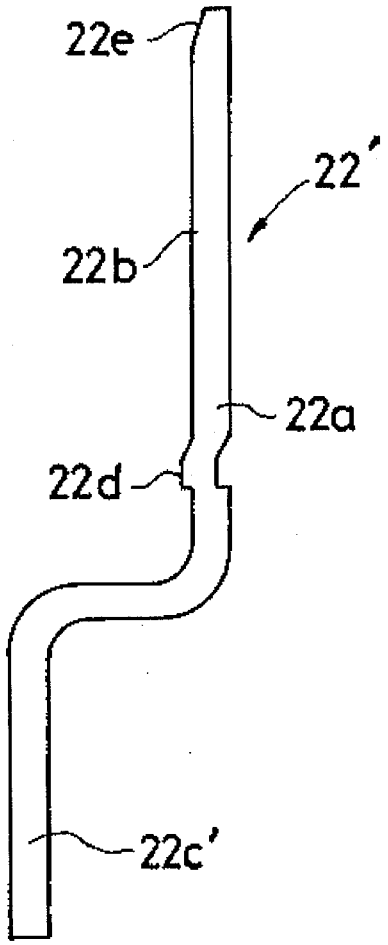

As shown in detail in FIG. 9(A) a second terminal 22 of one type, is substantially straight and comprises an anchoring portion 22*a* with an anchoring projection or tooth 22*d* struck therefrom for force fitting in the housing and joined at respective opposite ends by an upwardly extending contact portion 22*b* with a bevelled tip 22*e* and a depending lead portion 22*c*.

As shown in detail in FIG. 9(B), the second terminal 22' of the other type has essentially the same configuration as terminal 22 except for a rearward crank in the lead part 22*c*'. The same symbols have therefore been used to identify similar parts.

Figure 10:
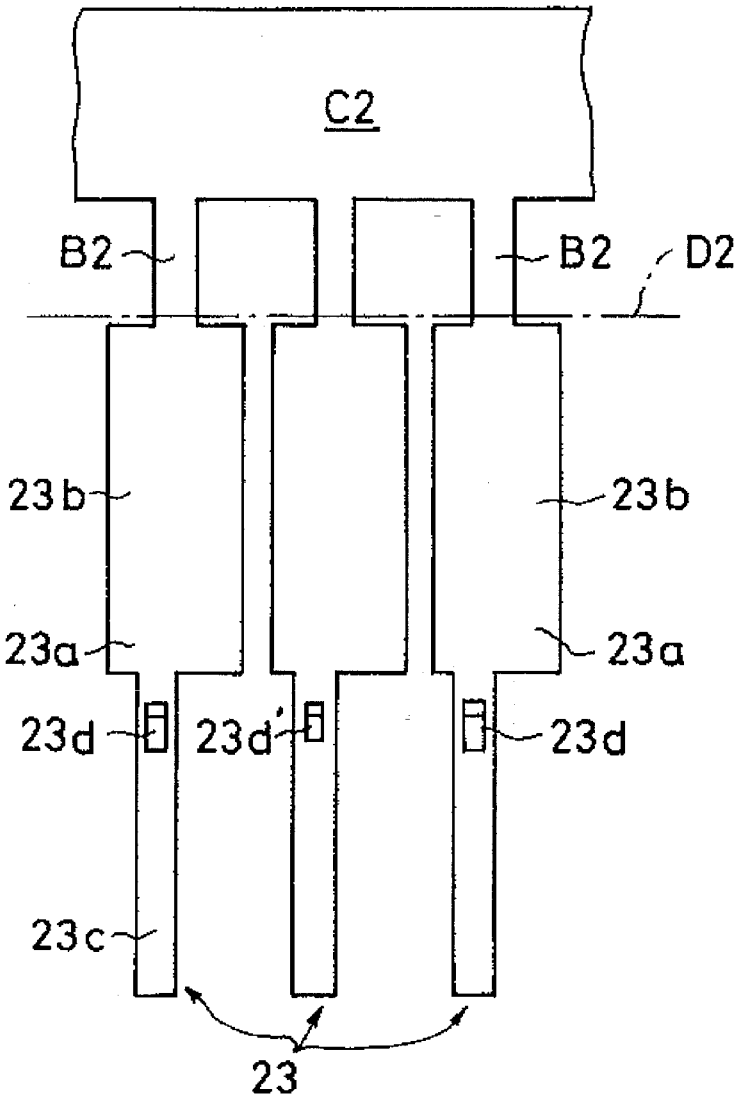
FIG. 10(A) is a plan view of ground plate portions of the first connector member.
FIG. 10(B) is an end view of the ground plate portion shown in FIG. 10(A)
Figure 10:
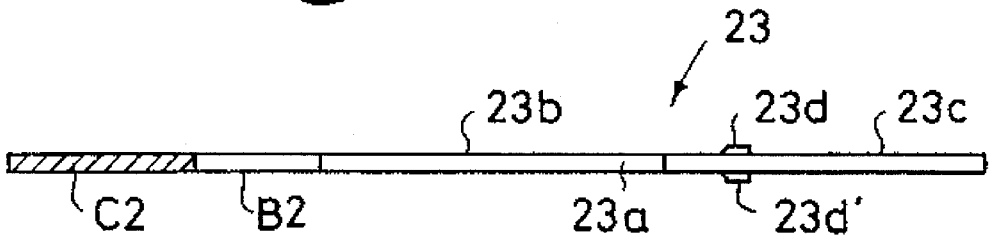

As shown in FIG. 10(A), the second center ground plate portions 23 are stamped and formed from a single piece of sheet metal extending transversely of a carrier strip C2.

As shown in FIG. 10(B), each second ground plate portion 23 is flat and comprises an anchoring portion 23*a* with an anchoring tooth or projection struck therefrom and joined at respective opposite ends by an upper terminal part 23*b* and a depending lead part 23*c*. The directions of projection of the anchoring portions 23*d* and 23*d*' formed on respective adjacent anchoring portions alternate. the second center ground plate portions 23 and the carrier C2 are joined by a bridge B2.

As shown in FIG. 6, upper parts of the second side ground plate portions 24, are formed in a wide plate shape from which depend narrow lead parts 24*a*.

The second connector member 2 is assembled by firstly press fitting the two types of second terminal 22, 22' into the terminal anchoring sockets 21*f* of the second housing 21 by insertion through the bottom, lead face, so that they are aligned as rows in the longitudinal direction of the second housing 21 with the beveled portions 22*e* protruding inwardly into the mating recess 21*a*, the contact portions 22*b* received in the terminal-receiving grooves 21*e*, and the lead portions 22*c*, 22*c*' depending from the lead or board connecting face.

The second center ground plate portions 23 are press fitted into the center ground plate portion anchoring sockets 21*g* by insertion through the lead face, carrier strip C2 leading, so that respective opposite contact faces 23*e* of successive plate portions of successive contact portions 23*b*, 23*b*' are exposed above the lower terminal supporting portions 21*c* and the other, supported faces are in supporting engagement with the supporting surfaces of the end portions 21*d*.

The second center ground plate portions 23 are then removed from the strip C2 by severing along the cutting line D2.

As shown in FIG. 8, the contact portions 23*b*, 23*b*' of the second center plate portions 23 are arranged in a row on the row center line S2.

The second side ground plate portions 24 are then press fitted into the side plate portion anchoring sockets 21*h* by insertion through the lead face so that upper parts of the second side ground plate portions 24 extend along the opposite inner surfaces of the walls 21*i* of the second housing 21 and project into the mating recess 21*a* with convex pimples 24*b* thereof protruding into the mating recesses 21*a*.

Figure 11:
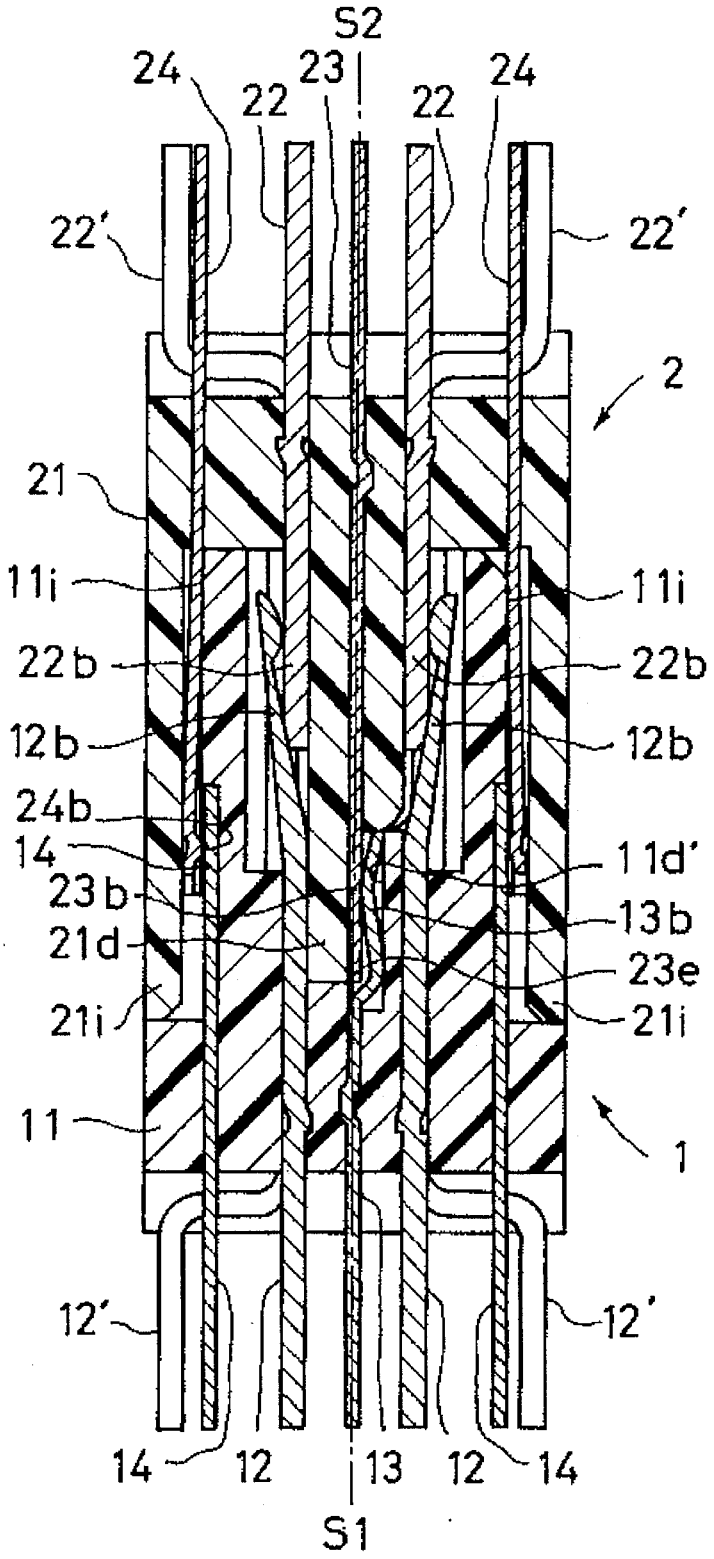
FIG. 11 is a cross-sectional view of the first and second connector members in mated condition; and, FIG. 12 is a schematic, plan view showing contact between the ground plate portions of the said connector members when mated.

On mating the first and second connector members, as may be seen from FIG. 11, initially, on shallow entry, sliding engagement between the outer surface of wall 11*i* of the first housing 11 and the outer wall 21*i* of the second housing 21 guides the connector members together enabling a coarse relative positioning thereof. As the insertion depth increases, the projecting end portions 21*c* of the second housing 21 are inserted into the mating recesses 11*a* of the first housing 11, and the outer walls 11*i* of the first housing 11 are inserted into the mating recesses 21*a* of the second housing 21 bringing the surfaces of the contact portion 22*b* of the second terminals 22 into deforming engagement with the resilient contact portions 12*b* of the first terminal 12 so that they are spread outward in the width direction. The end portions 21*d* of the second housing 21 are inserted into the plate portion-receiving openings 11*d* of the first housing together with the contact parts 23*b* of the second center ground plate portions 23 supported thereby so that respective guide ribs on respective guide surfaces thereof are received as sliding fits between portions of adjacent terminals 12 which protrude into the cavities in spaced apart parallel relation, enabling a final precise positioning of the first and second connector members 1 and 2 in the longitudinal direction.

The contact surfaces 23*e* of the second center ground plate portions 23, resiliently deform the resilient contact portions 13*b* (13*b*') of the first center ground plate portions 13 near the inner surfaces 11*d*' of the plate portion-receiving openings 11*d*.

Figure 12:
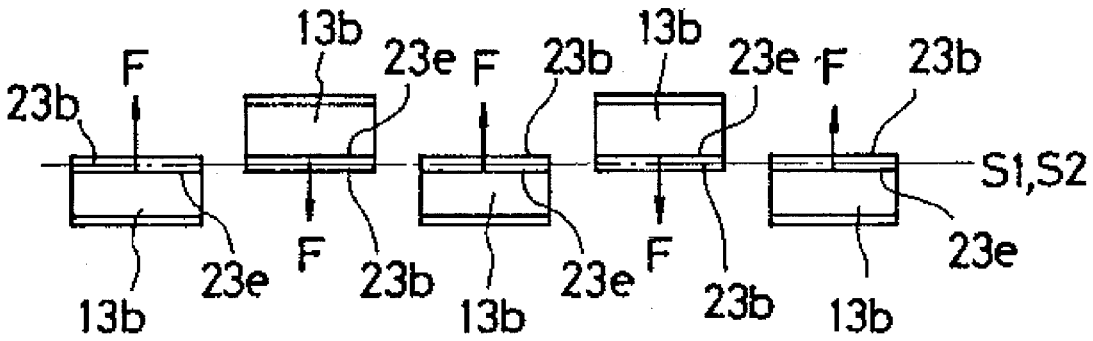

As shown in FIG. 12, lateral holding forces F arising from the resiliency of successive contact portions 13*b* act on the contact portions 23*b* from both lateral sides of the longitudinal axis L in alternate directions ensuring that the center line of the second housing 21 which holds the second center ground plate portions 23 does not deviate laterally from the center line of the second housing 21. In addition, the second side ground plate portions 24 engage the convex protuberances or pimples 24*b* of the first side ground plate portions 14.

As explained above, the simplified structures and similar shapes of the ground plate portions of the first connector member together with their staggered mounting arrangement enabling the formation of the ground plate portions of the second connector members for example, in the shape of a single plate portion enables these ground plate portions to be manufactured easily. The ground plate portions 23 may be integrally joined together forming a single grounding strip or bus.

Furthermore, the guiding receipt of the ground plate portions and guide surfaces of the respective projecting end portions of the second connector member in the cavities of the first connector member which receive the resilient contact portions of the ground plate portions enables the final, precise positioning of the two housings.

I claim:

1. An electrical connector assembly comprising first and second, intermatable connector members including first and second insulating housings, respectively, with first and second mating and lead faces, respectively; first and second rows of terminals retained in each housing and first, second and third rows of ground plate portions retained in each housing with the second row of ground plate portions located in the respective housings between first and third rows of the ground plate portions which are located adjacent opposite sides of the respective housings, all rows in each housing extending in spaced apart, side by side relation with the first row of terminals extending between the first and second rows of ground plate portions and the second row of terminals extending between the second and third rows of ground plate portions, respectively, so that terminals of the first row of terminals and the terminals of the second row of terminals are electrically shielded from each other by ground plate portions of the second row of ground plate portions and so that terminals of the first and second rows are electrically shielded from outside by ground plate portions of the first row of ground plate portions and by ground plate portions of the third row of ground plate portions, respectively, the ground plate portions of the second row of ground plate portions of the first connector member having respective resilient contact portions, successive ones of which are staggered so that alternate resilient contact portions are laterally offset from each other on respective opposite lateral sides of a center line of the row thereof;

the ground plate portions of the second row of ground plate portions of said second connector member being substantially coplanar and having contact faces;

the first housing being formed with a row of ground plate contact portion receiving cavities opening to the mating face; and, the second housing being formed with a row of ground plate portion supporting members having respective leading free ends projecting towards the mating face and formed with supporting surface portions and guiding surface portions facing in opposite lateral directions, successive ones of the leading free ends being staggered so that alternate leading free ends are laterally offset from each other on respective opposite lateral sides of a center line of the row of ground plate portions with successive supporting surface portions engaging opposite faces of successive ground plate portions of the second row of ground plate portions of the second connector member so that successive contact surfaces thereof are exposed in opposite lateral directions, so that, during movement of the connectors into mating engagement, the leading free ends of the ground plate portion supporting members enter respective contact portion receiving cavities both supporting the respective contact surface of the ground plate portions of the second row of ground plate portions in electrically connecting engagement with the respective resilient contact portions therein with resilient deflection thereof, and guiding the connector members together accurately so that corresponding terminals of the first and second connector members are interconnected.

2. An electrical connector assembly according to claim 1, in which the respective guiding surface portions are formed with guide ribs extending away from the mating face and respective ground plate contact portion receiving cavities have laterally opposite side walls and respective ground plate contact portions of the second row of ground plate portions are adjacent one side wall and a pair of terminals extends adjacent the opposite side wall in parallel, spaced apart relation formed guide rails for receiving between them respective guide ribs as sliding fits during mating.

3. An electrical connector assembly according to claim 1, in which the row of ground plate portion supporting members extends from a central, terminal supporting rib which is bisected by the ground plate portions of the second row of ground plate portions of the second connector.

4. An electrical connector assembly comprising first and second, intermatable connector members including first and second insulating housings, respectively, with first and second mating and lead faces, respectively; first and second rows of terminals retained in each housing and first, second and third rows of ground plate portions retained in each housing with the second row of ground plate portions located in the respective housings between first and third rows of the ground plate portions which are located adjacent opposite sides of the respective housings, all rows in each housing extending in spaced apart, side by side relation with the first row of terminals extending between the first and second rows of ground plate portions and the second row of terminals extending between the second and third rows of ground plate portions, respectively, so that terminals of the first row of terminals and the terminals of the second row of terminals are electrically shielded from each other by ground plate portions of the second row of ground plate portions and so that terminals of the first and second rows are electrically shielded from outside by ground plate portions of the first row of ground plate portions and by ground plate portions of the third row of ground plate portions, respectively, the ground plate portions of the second row of ground plate portions of the first connector member having respective resilient contact portions, successive ones of which are staggered so that alternate resilient contact portions are laterally offset from each other on respective opposite lateral sides of a center line of the row thereof;

the ground plate portions of the second row of ground plate portions of the said second connector member being substantially coplanar and having contact faces;

the first housing being formed with a row of ground plate contact portion receiving cavities opening to the mating face; and, the second housing being formed with a row of ground plate portion supporting members having respective leading free ends projecting towards the mating face and formed with supporting surface portions and guiding surface portions, so that movement of the connectors into mating engagement inserts the leading free ends of the ground plate portions supporting members into respective contact portion receiving cavities both supporting the respective contact surfaces of the ground plate portions of the second row of ground plate portions in electrically connecting engagement with the respective resilient contact portions therein with resilient deflection thereof, and guiding the connector members together accurately so that corresponding terminals of the first and second connector members are interconnected.

5. An electrical connector assembly according to claim 4, in which the leading free ends are finger-like with respective supporting surface portions and guiding surface portions on respective opposite lateral sides thereof.

6. An electrical connector assembly comprising first and second, intermatable connector members including first and second insulating housings, respectively, with first and second mating and lead faces, respectively; a row of terminals and a row of ground plate portions retained in each housing, extending in spaced apart, side by side relation;

the ground plate portions of the first connector member having respective resilient contact portions, successive ones of which are staggered so that alternate resilient contact portions are laterally offset from each other on respective opposite lateral sides of a center line of the row thereof;

the ground plate portions of the second connector member being substantially coplanar and having contact faces;

the first housing being formed with a row of ground plate contact portion receiving cavities opening to the mating face; and, the second housing being formed with a row of ground plate portion supporting members having respective leading free ends projecting towards the mating face and formed with supporting surface portions and guiding surface portions facing in opposite lateral directions, successive ones of the leading free ends being staggered so that alternate leading free ends are laterally offset from each other on respective opposite lateral sides of a center line of the row of ground plate portions with successive supporting surface portions engaging opposite faces of successive ground plates of the second connector member so that successive contact surfaces thereof are exposed in opposite lateral directions, so that, during movement of the connectors into mating engagement, the leading free ends of the ground plate portion supporting members enter respective contact portion receiving cavities both supporting the respective contact surfaces of the ground plate portions in electrically connecting engagement with the respective resilient contact portions therein with resilient deflection thereof, and guiding the connector members together accurately so that corresponding terminals of the first and second connector members are interconnected; the respective guiding surface portions being formed with guide ribs extending away from the mating face; respective ground plate contact portion receiving cavities having laterally opposite side walls and respective ground plate contact portions being adjacent one side wall and a pair of terminals extending adjacent the opposite side wall in parallel, spaced apart relation forming guide rails for receiving between them respective guide ribs as sliding fits during mating.

7. An electrical connector assembly comprising first and second, intermatable connector members including first and second insulating housings, respectively, with first and second mating and lead faces, respectively; a row of terminals and a row of ground plate portions retained in each housing, extending in spaced apart, side by side relation;

the ground plate portions of the first connector member having respective resilient contact portions, successive ones of which are staggered so that alternate resilient contact portions are laterally offset from each other on respective opposite lateral sides of a center line of the row thereof;

the ground plate portions of the second connector member being substantially coplanar and having contact faces;

the first housing being formed with a row of ground plate contact portion receiving cavities opening to the mating face; and, the second housing being formed with a row of ground plate portion supporting members having respective leading free ends projecting towards the mating face and formed with supporting surface portions and guiding surface portions facing in opposite lateral directions, successive ones of the leading free ends being staggered so that alternate leading free ends are laterally offset from each other on respective opposite lateral sides of a center line of the row of ground plate portions with successive supporting surface portions engaging opposite faces of successive ground plates of the second connector member so that successive contact surfaces thereof are exposed in opposite lateral directions, so that, during movement of the connectors into mating engagement, the leading free ends of the ground plate portion supporting members enter respective contact portion receiving cavities both supporting the respective contact surfaces of the ground plate portions in electrically connecting engagement with the respective resilient contact portions therein with resilient deflection thereof, and guiding the connector members together accurately so that corresponding terminals of the first and second connector members are interconnected; the row of ground plate portion supporting members extending from a central, terminal supporting rib which is bisected by the ground plate portions of the second connector.

* * * * *